US005529032A

United States Patent [19]

Oikawa et al.

[11] Patent Number: 5,529,032

[45] Date of Patent: Jun. 25, 1996

[54] VALVE-OPERATION CONTROL SYSTEM FOR INTERNAL COMBUSTION ENGINE

[75] Inventors: Toshihiro Oikawa; Yukio Nakayama; Kenji Nakajima, all of Saitama, Japan

[73] Assignee: Honda Giken Kogyo Kabushiki Kaisha, Tokyo, Japan

[21] Appl. No.: 397,667

[22] Filed: Feb. 28, 1995

[30] Foreign Application Priority Data

Feb. 28, 1994 [JP] Japan ..... 6-029203

[51] Int. Cl.[6] ..... F01L 13/00; F02B 75/02

[52] U.S. Cl. ..... 123/90.16; 123/90.6

[58] Field of Search ..... 123/90.15, 90.16, 123/90.22, 90.27, 90.31, 90.39, 90.4, 90.6

[56] References Cited

U.S. PATENT DOCUMENTS

| | | | |
|---|---|---|---|
| 5,107,805 | 4/1992 | Butterfield et al. | 123/90.31 |
| 5,363,818 | 11/1994 | Iwata et al. | 123/90.16 |
| 5,388,552 | 2/1995 | Sugimoto et al. | 123/90.16 |

FOREIGN PATENT DOCUMENTS

| | | |
|---|---|---|
| 240446 | 10/1987 | European Pat. Off. . |
| 475727A2 | 3/1992 | European Pat. Off. . |
| 583583A2 | 2/1994 | European Pat. Off. . |
| 639693A1 | 2/1995 | European Pat. Off. . |
| 2937088 | 4/1981 | Germany . |
| 432212A1 | 1/1995 | Germany . |
| 2-264123 | 10/1990 | Japan . |
| 2197686 | 5/1988 | United Kingdom . |

*Primary Examiner*—Weilun Lo
*Attorney, Agent, or Firm*—Lyon & Lyon

[57] ABSTRACT

A valve-operation control system for an internal combustion engine includes a timing transmitting device for transmitting the rotational power of a crankshaft at a speed reduction ratio of 1/4 to a cam shaft, and intake-side and exhaust-side valve operating devices. Each of the valve operating device includes a first cam provided on the cam shaft and having a single cam lobe protruding outwardly with a valve-opening profile suitable for an extremely low-speed operation of the engine, a second cam provided on the cam shaft and having a pair of cam lobes provided at locations circumferentially spaced apart through 180 degrees to protrude outwardly with an opening profile suitable for a low-speed operational state of the engine, a third cam provided on the cam shaft and having a pair of cam lobes provided at locations circumferentially spaced apart through 180 degrees to protrude outwardly with an opening profile suitable for a high-speed operational state of the engine, with first, second and third rocker arms following the first, second and third cams, respectively. A connection switchover device is provided in the first, second and third rocker arms for switching the selective connection and disconnection of the rocker arms in accordance with the operational state of the engine. The first rocker arm is operatively connected to the intake or exhaust valves for operation of the valves in an 8-cycle mode to inhibit the discharge of a harmful hydrocarbons at an extremely slow speed of the engine.

6 Claims, 10 Drawing Sheets

VALVE-OPERATION CONTROL SYSTEM FOR INTERNAL COMBUSTION ENGINE

BACKGROUND OF THE INVENTION

1. Field of the Invention

The present invention relates to a valve-operation control system for an internal combustion engine, wherein the operating characteristics of an intake valve and an exhaust valve can be changed in accordance with the operational state of the engine.

2. Description of the Prior Art

A valve-operation control system for an internal combustion engine is conventionally known from Japanese Patent Application Laid-open No. 264123/90, in which a technique for operating a particular cylinder in a 4-cycle mode and stopping other cylinders in a low loading of the engine and for operating all the cylinders in a 6-cycle in a high loading of the engine is achieved by a timing of opening and closing of electromagnetically driven intake and exhaust valves.

When the temperature of an exhaust gas flowing into a catalytic converter incorporated in an exhaust system is low, a large amount of harmful hydrocarbon is discharged due to the fact that the temperature of a catalyst within the catalytic converter does not reach an activating temperature. When the engine is at an extremely low speed such as at a low-temperature start, it is desired that the temperature of the exhaust gas be promptly increased, but in the prior art system a prompt increase in the temperature of the exhaust gas cannot be expected.

SUMMARY OF THE INVENTION

Accordingly, it is an object of the present invention to provide a valve-operation control system for an internal combustion engine, wherein when the engine is at an extremely low speed, the temperature of the exhaust gas can be increased promptly to suppress the discharge of a harmful hydrocarbon, and when the engine is in a usual operation, the operating characteristics of intake and exhaust valves can be suited to the operational state of the engine, thereby achieving a reduction in specific fuel consumption and an increase in power output.

To achieve the above object, according to the present invention, there is provided a valve-operation control system for an internal combustion engine, comprising a timing transmitting device for transmitting the rotational power of a crankshaft at a speed reduction ratio of 1/4 to a cam shaft; and intake-side and exhaust-side valve operating devices each including a first cam provided on the cam shaft and having a single cam lobe protruding outwardly with a valve-opening profile suitable for an extremely low-speed operation of the engine, a second cam provided on the cam shaft and having a pair of cam lobes provided at locations circumferentially spaced apart through 180 degrees to protrude outwardly with a valve-opening profile suitable for a low-speed operational state of the engine, a third cam provided on the cam shaft and having a pair of cam lobes provided at locations circumferentially spaced apart through 180 degrees to protrude outwardly with a valve-opening profile suitable for a high-speed operational state of the engine, first, second and third rocker arms following the first, second and third cams, respectively, and a connection switchover means provided in the first, second and third rocker arms and capable of switching the selective connection and disconnection of the first rocker arm to and from the second and/or third rocker arms depending upon the extremely low--speed, low-speed and high-speed operational states of the engine, said first rocker arm being operatively connected to an intake or exhaust valves.

With the above arrangement, when the engine is at an extremely low speed, it is possible to effectively inhibit the discharge of a harmful hydrocarbon by causing an increase in the temperature of the exhaust gas with the engine being in an 8-cycle operation. When the engine is in a low-speed operational state and a high-speed operational state, it is possible to provide a reduction in specific fuel consumption and an increase in power output by opening and closing the intake and exhaust valves with operating characteristics suited to each of operational states with the engine being in a normal 4-cycle operation.

The above and other objects, features and advantages of the invention will become apparent from the following description of the preferred embodiment taken in conjunction with the accompanying drawings.

DESCRIPTION OF THE PREFERRED EMBODIMENTS

The present invention will now be described by way of a preferred embodiment applied to a DOHC type 4-cylinder internal combustion engine with reference to the accompanying drawings.

Figure 1:
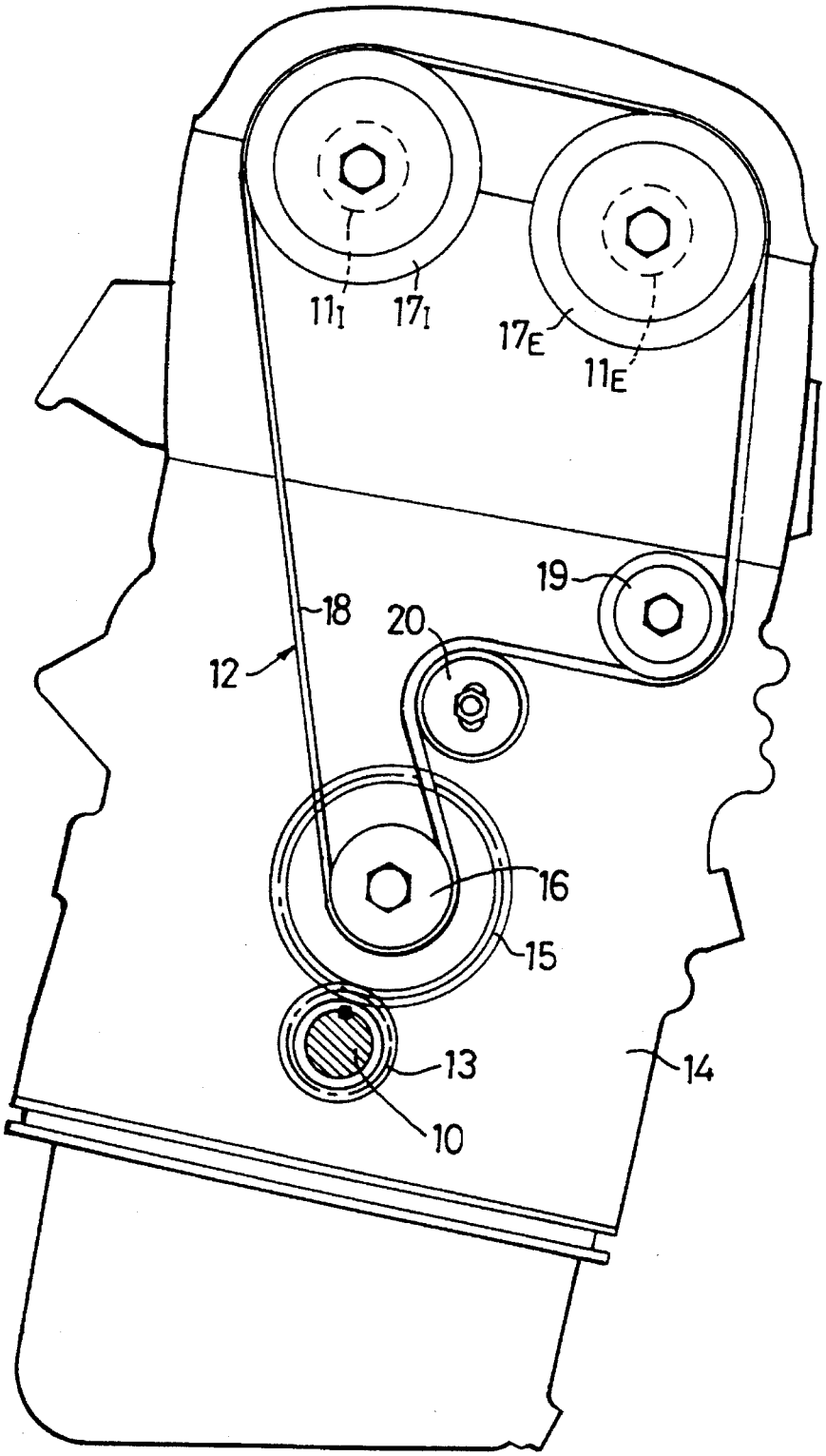
FIG. 1 is a side elevation view of an internal combustion engine.

Referring first to FIG. 1, in this DOHC type 4-cylinder internal combustion engine, a timing transmitting device 12 is provided between a crankshaft 10 and an intake-side cam shaft $\mathbf{11}_I$ and an exhaust-side cam shaft $\mathbf{11}_E$ to transmit a rotative driving force of the crankshaft 10 to both the cam shafts $\mathbf{11}_I$ and $\mathbf{11}_E$ at a reduction ratio of 1/4. The timing transmitting device 12 includes, for example, a driving gear 13 fixed to the crankshaft 10, a driven gear 15 rotatably carried in a cylinder block 14 in a meshed relation to the driving gear 13, a driving pulley 16 coaxially connected to the driven gear 15, driven pulleys $\mathbf{17}_I$ and $\mathbf{17}_E$ fixed to ends of the cam shafts $\mathbf{11}_I$ and $\mathbf{11}_E$, respectively, an endless timing belt 18 reeved around the driving pulley 16 and the driven pulleys $17_I$ and $17_E$, an idle pulley 19 rotatably carried on the cylinder block 14 and engaged with the middle portion of the timing belt 18, and an adjuster 20 engaged with the timing belt from an outer peripheral side thereof between the idle pulley 19 and the driving pulley 16. The reduction ratio is determined at 1/4 by, for example, setting the ratio of outside diameters of the driving gear 13 and the driven gear 15 at 1:2 and setting the ratio of outside diameters of the driving pulley 16 and the driven pulleys $17_I$ and $17_E$ at 1:2.

Figure 2:
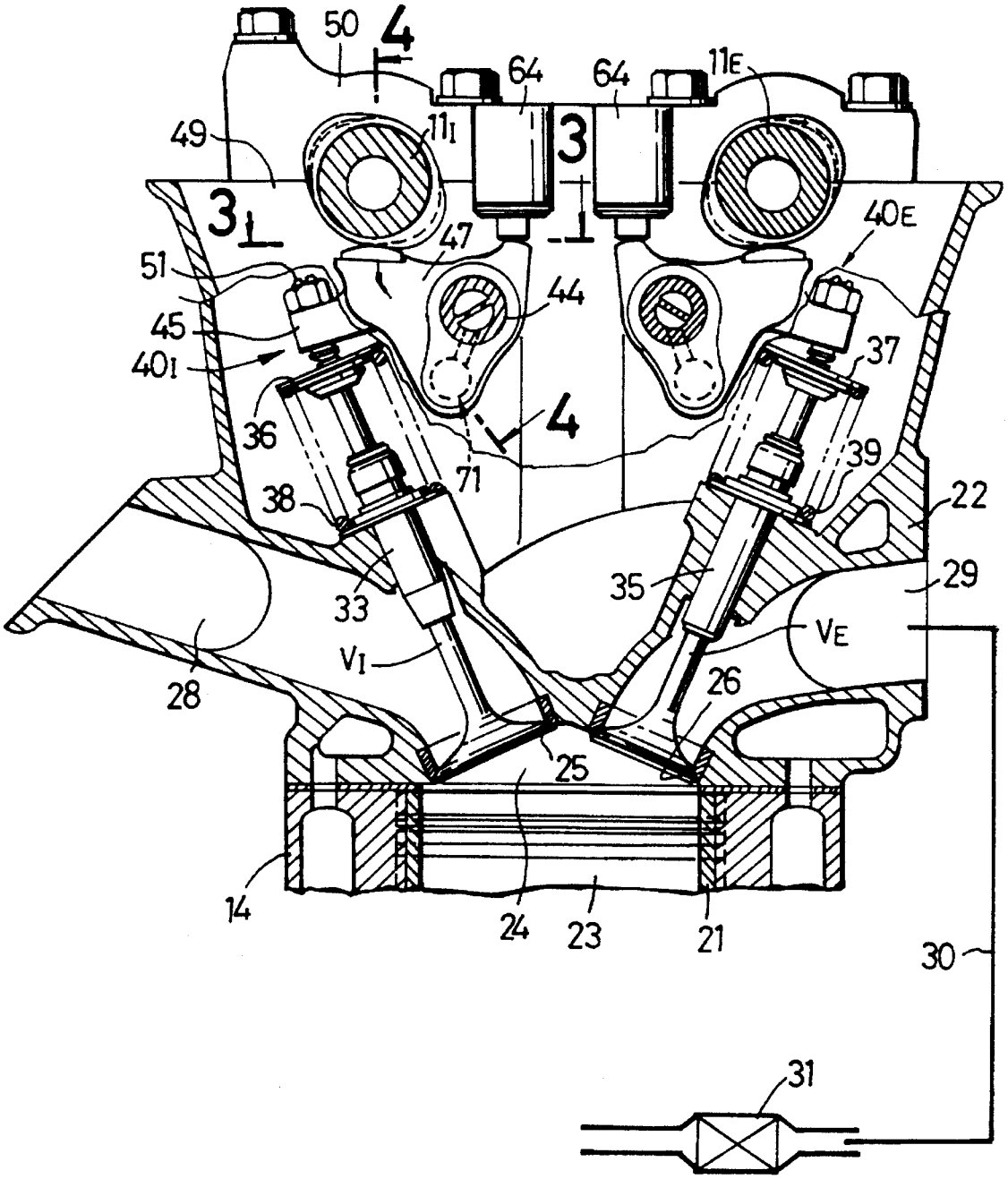
FIG. 2 is a vertical sectional view of an essential portion of the internal combustion engine.

Referring to FIG. 2, four cylinders 21 are mounted in a serial arrangement within the cylinder block 14, and a combustion chamber 24 is defined between a cylinder head 22 coupled to an upper end of the cylinder block 14 and each piston 23 slidably received in the cylinders 21. A pair of intake valve bores 25 and a pair of exhaust valve bores 26 are provided at that portion of the cylinder head 22 which constitutes a ceiling surface of each of the combustion chambers 24. An intake port 28 is provided in the cylinder head 22 to open into one of side of the cylinder head 22 and to communicate with each intake valve bore 25. An exhaust port 29 is also provided in the cylinder head 22 to open into the other side of the cylinder head 22 and to communicate with each exhaust valve bore 26. Further, a catalytic converter 31 having a ternary catalyst therein is incorporated in the middle of an exhaust system 30 connected commonly to the exhaust ports 29 for all four cylinders.

Fitted and fixed in a portion of the cylinder head 22 corresponding to each of the cylinders 21 are a pair of guide sleeves 33 for guiding a pair of intake valves $V_I$ capable of opening and closing the intake valve bores 25, respectively, and a pair of guide sleeves 35 for guiding a pair of exhaust valves $V_E$ capable of opening and closing the exhaust valve bores 26, respectively. Valve springs 38 and 39 are mounted under compression between the cylinder head 22 and collars 36 and 37 provided at upper ends of the intake and exhaust valves $V_I$ and $V_E$ projecting from the guide sleeves 33 and 35, so that the intake and exhaust valves $V_I$ and $V_E$ are biased upwardly, i.e., in valve-closing directions by spring forces of the valve springs 38 and 39, respectively.

An intake-side valve operating device $40_I$ is connected to the intake valves $V_I$, and an exhaust-side valve operating device $40_E$ is connected to the exhaust valves $V_E$.

Figure 3:
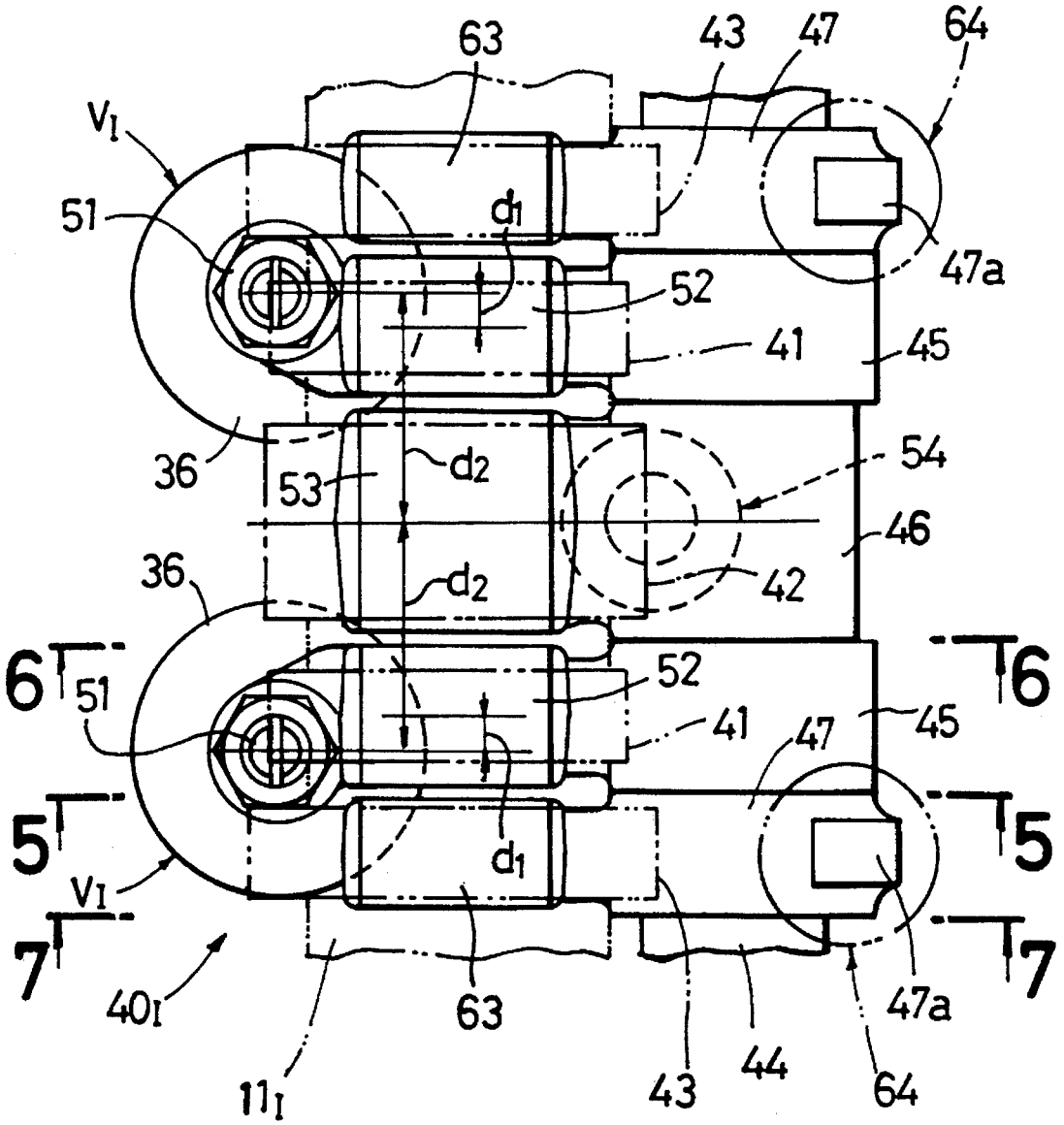
FIG. 3 is an enlarged view taken along a line 3—3 in FIG. 2.
Figure 4:
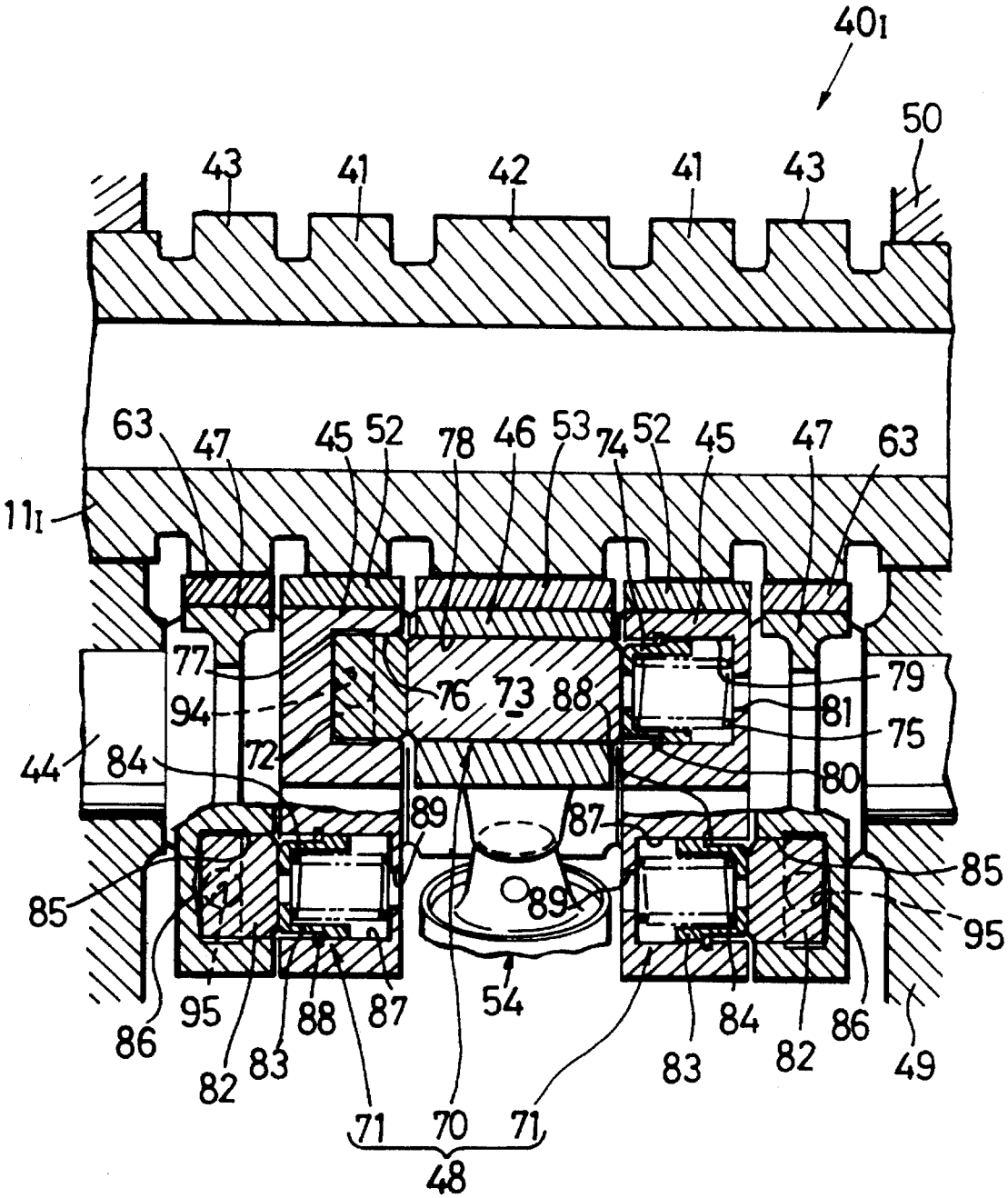
FIG. 4 is an enlarged sectional view taken along a line 4—4 in FIG. 2.

Referring to FIGS. 3 and 4, the intake-side valve operating device $40_I$ includes the cam shaft $11_I$, a pair of first cams 41, 41, a single second cam 42 and a pair of third cams 43, 43 provided on the cam shaft $11_I$, a rocker arm shaft 44 fixedly disposed parallel to the cam shaft $11_I$, a pair of first rocker arms 45, 45, a single second rocker arm 46 and a pair of third rocker arms 47, 47 swingably carried on the rocker arm shaft 44, and a connecting switch-over means 48 provided on the rocker arms 45, 46 and 47.

The cam shaft $11_I$ is rotatably carried for rotation about an axis between a lower holder 49 integrally provided in the cylinder head 22 and an upper holder 50 fastened to the lower holder 49. The pair of third cams 43 are disposed on opposite sides of the single second cam 42, and the pair of first cams 41 are disposed between the second cam 42 and the third cams 43, respectively.

Figure 5:
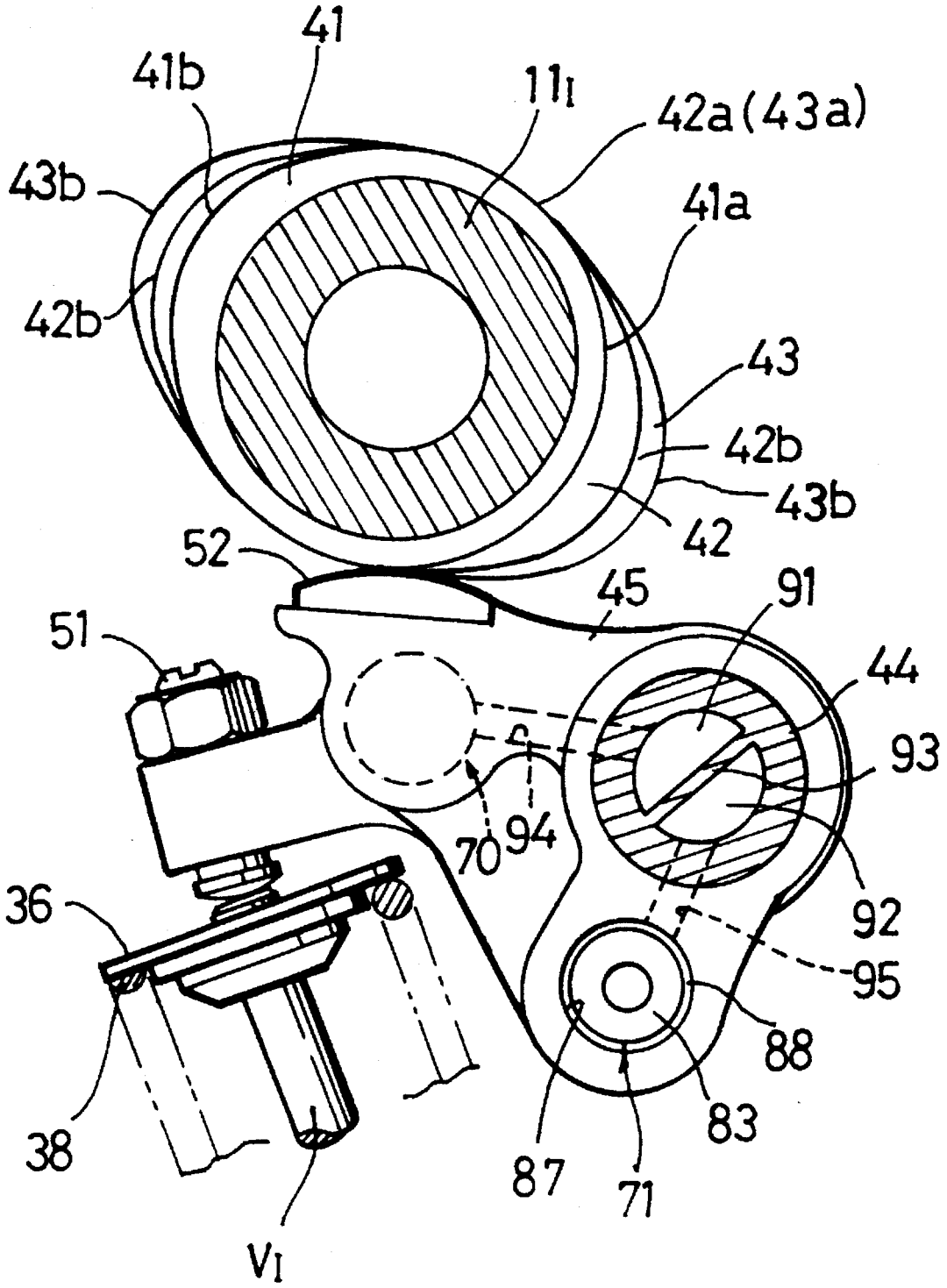
FIG. 5 is a sectional view taken along a line 5—5 in FIG. 3.
Figure 6:
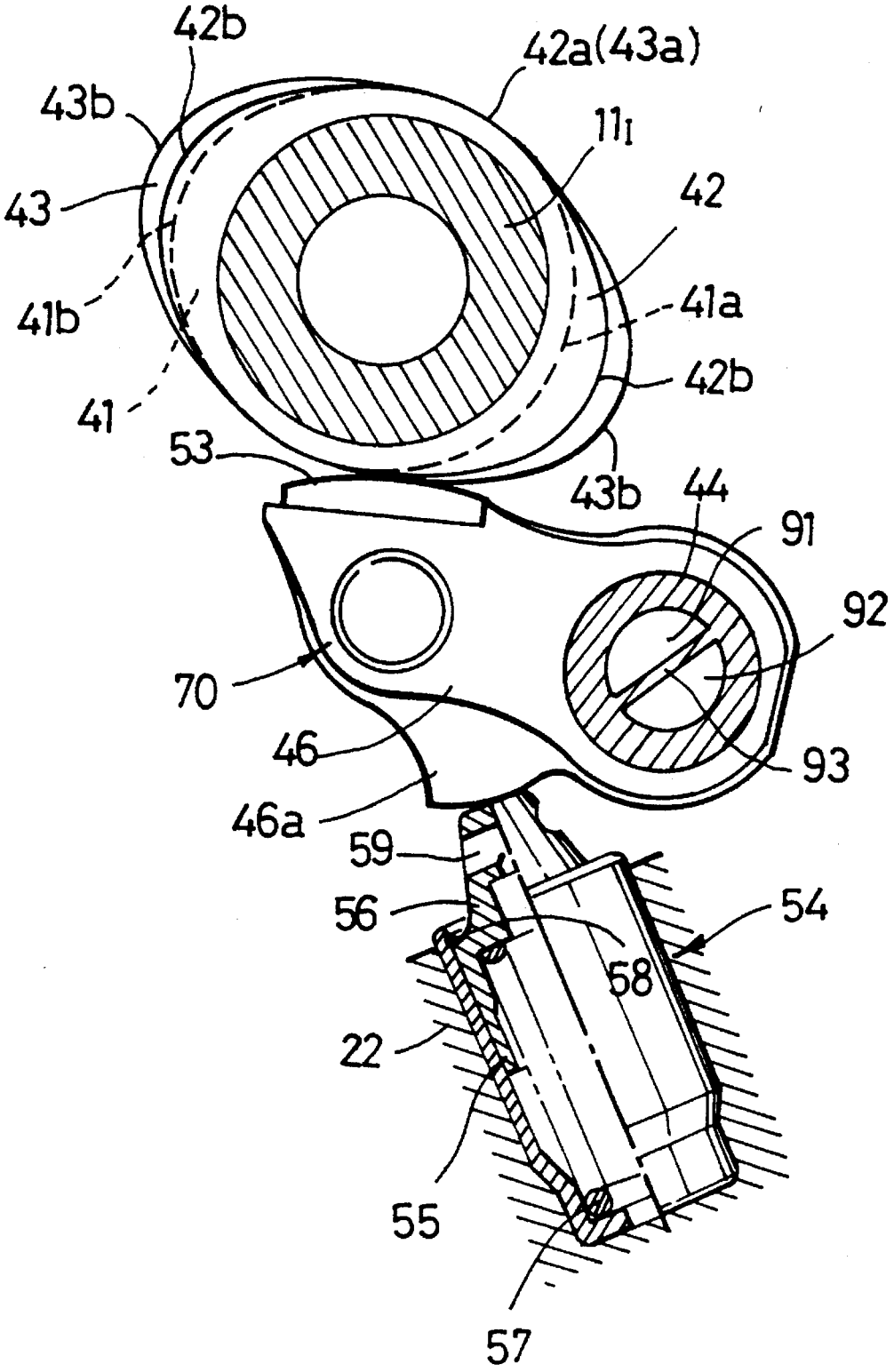
FIG. 6 is a sectional view taken along a line 6—6 in FIG. 3.
Figure 7:
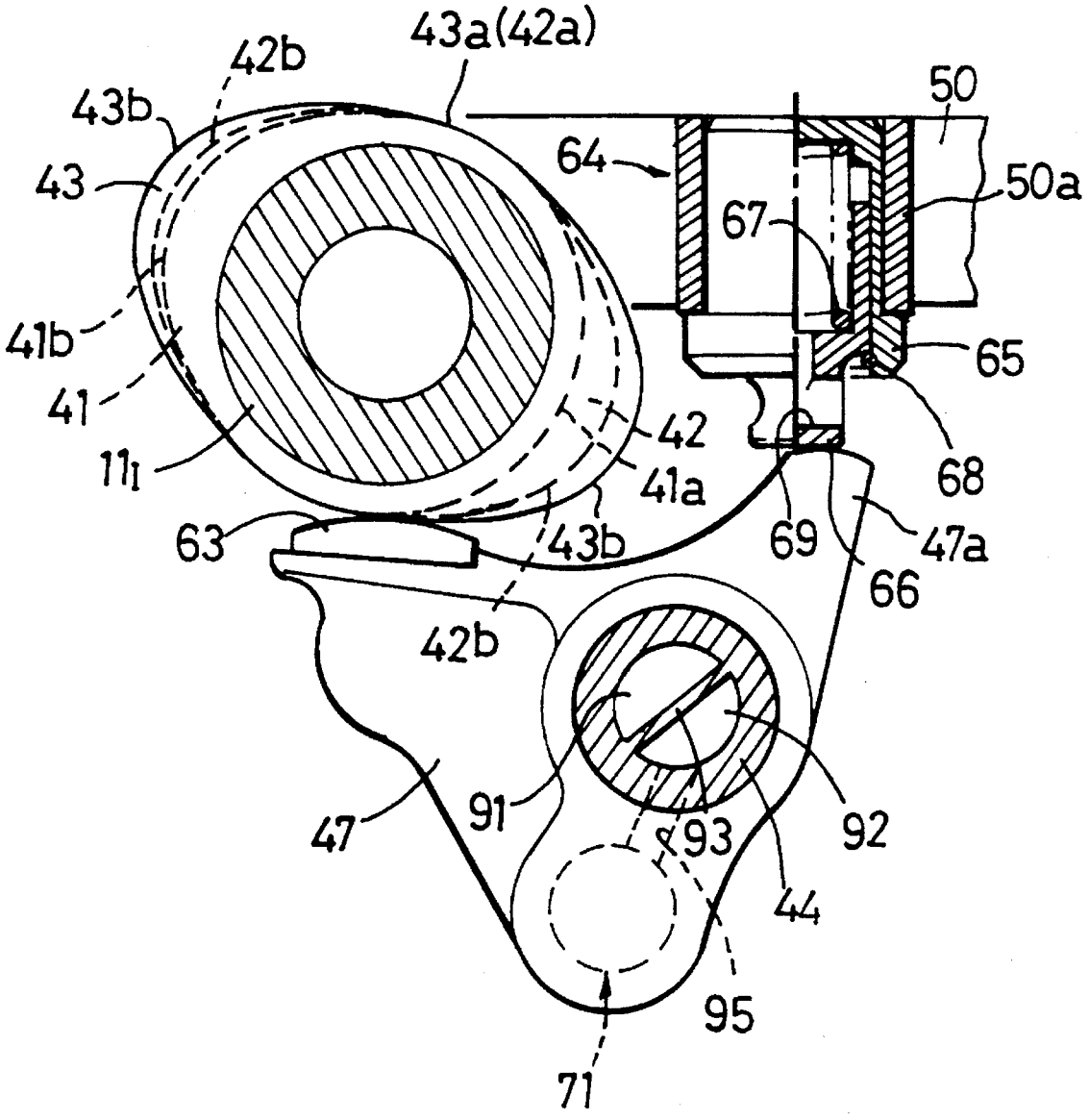
FIG. 7 is a sectional view taken along a line 7—7 in FIG. 3.

Referring to FIGS. 5, 6 and 7, each of the first cams 41 has, around its outer periphery, a base circle-portion 41*a* which is circular coaxially with the cam shaft $11_I$ and a single cam lobe 41*b* protruding radially outwardly from one circumferential portion of the base circle-portion 41*a* with a valve-opening profile suitable for an extremely low speed operation of the engine, e.g., at the start of the engine at a low temperature. The single second cam 42 has, around its outer periphery, a base circle-portion 42*a* formed coaxially with the cam shaft $11_I$ with the same diameter as the base circle-portion 41*a*, and a pair of cam lobes 42*b*, 42*b* protruding radially outwardly from the base circle-portion 42*a* with a valve-opening profile suitable for the operation of the engine at a low speed. The cam lobes 42*b*, 42*b* are disposed at locations circumferentially spaced apart from each other through 180 degrees, and one of the cam lobes 42*b* is disposed at the same position as the cam lobe 41*b* of the first cam 41 in a circumferential direction of the cam shaft $11_I$. Each of the third cams 43 has, around its outer periphery, a base circle-portion 43*a* formed coaxially with the cam shaft $11_I$ with the same diameter as the base circle-portions 41*a* and 42*a*, and a pair of cam lobes 43*b*, 43*b* protruding radially outwardly from the base circle-portion 43*a* with a valve-opening profile suitable for the operation of the engine at a high speed. The cam lobes 43*b*, 43*b* are disposed at locations circumferentially spaced apart from each other through 180 degrees at the same phase as the cam lobes 42*b*, 42*b* of the second cam 42.

The rocker arm shaft 44 has an axis parallel to the cam shaft $11_I$ and is fixedly retained on the lower holder 49 in the cylinder head 22 at a location below the cam shaft $11_I$. Carried swingably in an adjacent relationship on the rocker arm shaft 44 are a pair of rocker arms 45, 45 operatively connected to the pair of intake valves $V_I$, $V_I$, respectively, a single second rocker arm 46 disposed between the pair of first rocker arms 45, 45, and a pair of third rocker arms 47, 47 disposed with the pair of first rocker arms 45, 45 interposed between the third rocker arms 47, 47 and the second rocker arm 46.

The pair of first rocker arms 45, 45 are swingably carried on the rocker arm shaft 44 to extend on the side of the intake valves $V_I$, $V_I$, and tappet screws 51, 51 are, advanceably and retreatably, threadedly engaged in tip ends of the first rocker arms 45, 45 to abut against the intake valves $V_I$, $V_I$. Thus, the intake valves $V_I$, $V_I$ are opened and closed in response to the swinging movement of the first rocker arms 45, 45. Moreover, as best shown in FIG. 3, the positions of threaded engagement of the tappet screws 51, 51 in the first rocker arms 45, 45, i.e., the positions of operative connection of the intake valves $V_I$, $V_I$ to the first rocker arms 45, 45, are offset toward the third rocker arms 47, 47 from the center positions of the first rocker arms 45, 45 along the axis of the rocker arm shaft 44 by an offset amount $d_1$, and the intake valves $V_I$, $V_I$ are operatively connected to the first rocker arms 45, 45 at locations spaced at substantially equal distances $d_2$, $d_2$ apart from the center position of the second rocker arm 46 along the axis of the rocker arm shaft 44, respectively.

Cam slippers 52, 52 are fixedly mounted on upper surfaces of intermediate portions of the first rocker arms 45, 45 between the positions of operative connection to the intake valves $V_I$, $V_I$ and the rocker arm shaft 44, respectively to come into sliding contact with the first cams 41, 41.

The second rocker arm 46 is swingably carried on the rocker arm shaft 44 to extend below the cam shaft $11_I$, and a cam slipper 53 is fixedly mounted on an upper portion of the second rocker arm 46 at its tip end to come into sliding contact with the second cam 42.

The second rocker arm 46 is resiliently biased in a direction to bring the cam slipper 53 into sliding contact with the second cam 42 by a lost motion mechanism 54 disposed in the cylinder head 22 substantially below the cam shaft $11_I$. Each lost motion mechanism 54 is comprised of a bottomed cylindrical member 55 fitted and fixed in the cylinder head 22 with its open end directed toward the second rocker arm 46, a lifter 56 slidably fitted in the bottomed cylindrical member 55, a spring 57 mounted under compression between the bottomed cylindrical member 55 and the lifter 56, and a slip-off preventing ring 58 fitted to an inner surface of the bottomed cylindrical member 55 at its open end to inhibit the slip-off of the lifter 56 from the bottomed cylindrical member 55. The lifter 56 is provided with an opening hole 59 which permits the space between the lifter 56 and the bottomed cylindrical member 55 to be opened to the outside. Thus, the lifter 56 protruding from the open end of the bottomed cylindrical member 55 resiliently abuts against a pressure receiving portion 46*a* provided at a lower portion of the second rocker arm 46 at its tip end, whereby the second rocker arm 46 is normally in sliding contact with the second cam 42 under the influence of a resilient force of the lost motion mechanism 54.

The pair of third rocker arms 47, 47 are swingably carried on the rocker arm shaft 44 to extend below the cam shaft $11_I$, and cam slippers 63, 63 are fixedly mounted on upper portions of the third rocker arms 47, 47 at their tip ends to come into sliding contact with the third cams 43, 43.

The third rocker arms 47, 47 are resiliently biased in a direction to bring the cam slippers 63, 63 into sliding contact with the third cams 43, 43 by lost motion mechanisms 64, 64 disposed on the upper holder 50 at locations in proximity to the axis of the rocker arm shaft 44. Each lost motion mechanism 64 is comprised of a bottomed cylindrical member 65 fitted and fixed with its open end directed toward the third rocker arm 47 in a cylindrical support sleeve 50*a* integrally provided in the upper holder 50, a lifter 66 slidably fitted in the bottomed cylindrical member 65, a spring 67 mounted under compression between the bottomed cylindrical member 65 and the lifter 66, and a retaining ring 68 fitted to an inner surface of the bottomed cylindrical member 65 at its open end to inhibit the slip-off of the lifter 66 from the bottomed cylindrical member 65. The lifter 66 is provided with an opening hole 69 which permits the space between the lifter 66 and the bottomed cylindrical member 65 to be opened to the outside. Thus, the lifter 66 protruding from the open end of the bottomed cylindrical member 65 resiliently abuts, in sliding contact, a pressure receiving portion 47*a* which is provided on a base portion of the third rocker arm 47 to protrude upwardly, whereby the third rocker arm 47 is normally in sliding contact with the third cam 43 under the influence of a resilient force of the lost motion mechanism 64.

Referring particularly to FIG. 4, the connection switchover means 48 includes a first switchover mechanism 70 provided between the second rocker arm 46 and the pair of first rocker arms 45, 45, and a second switchover mechanism 71 provided between each pair of adjacent first and third rocker arms 45 and 47.

The first switchover mechanism 70 includes a first switchover pin 72 disposed in one of the first rocker arms 45 on one side of the second rocker arm 46 at a location below the cam shaft $11_I$ and capable of connecting that one first rocker arm 45 and the second rocker arm to each other, a second switchover pin 73 disposed in the second rocker arm 46 with one end abutting against the first switchover pin 72 and capable of connecting the second rocker arm 46 and the other first rocker arm 45 to each other, a limiting member 74 abutting against the other end of the second switchover pin 73, and a return spring 75 for biasing the switchover pins 72 and 73 and the limiting member 74 to rocker arm disconnecting positions.

A first bottomed guide hole 76 is provided in the one first rocker arm 45 in parallel to the rocker arm shaft 44, and opens toward the second rocker arm 46. The first switchover pin 72 is of a columnar shape and is slidably fitted in the first guide hole 76 to define a hydraulic pressure chamber 77 between one end of the first switchover pin 72 and a closed end of the first guide hole 76.

A through guide hole 78 is provided in the second rocker arm 46 in alignment with the first guide hole 74 and parallel to the rocker arm shaft 44 to extend between opposite sides, and the second switchover pin 73 having one end abutting against the other end of the first switchover pin 72 is slidably fitted in the guide hole 78.

A second bottomed guide hole 79 is provided in the other first rocker arm 45 in parallel to the rocker arm shaft 44 and opens toward the second rocker arm 46 in alignment with the guide hole 78, and the bottomed cylindrical limiting member 74 abutting against the other end of the second switchover pin 73 is slidably fitted in the second bottomed guide hole 79. The return spring 75 is mounted under compression between the limiting member 74 and a closed end of the second guide hole 79. A retaining ring 80 is fitted to an inner surface of the second guide hole 79 for engagement with the limiting member 74 to inhibit the slip-off of the limiting member 74 from the second guide hole 79, and an opening bore 81 is provided in the closed end of the second guide hole 79.

In such first switchover mechanism 70, the application of a hydraulic pressure to the hydraulic pressure chamber 77 causes the first switchover pin 72 to be fitted into the guide hole 78 while, at the same time, causing the second switchover pin 73 to be fitted into the second guide hole 79, thereby connecting the second rocker arm 46 and the first rocker arms 45, 45 to each other. If the hydraulic pressure in the hydraulic pressure chamber 77 is released, the first switchover pin 72 is returned by the spring force of the return spring 75 to a position in which its face abutting against the second switchover pin 73 corresponds to the space between the one first rocker arm 45 and the second rocker arm 46, and the second switchover pin 73 is returned to a position in which its face abutting against the limiting member 74 corresponds to the space between the second rocker arm 46 and the other first rocker arm 45, so that the connection of the second rocker arm 46 and the first rocker arms 45, 45 is released. Moreover, the connection and disconnection of the second rocker arm 46 and the first rocker arms 45, 45 are performed in a condition in which the second rocker arm 46 is in sliding contact with the base circle-portion 42*a* of the second cam 42 and the first rocker arms 45, 45 are in sliding contact with the base circle-portions 41*a* of the first cams 41, 41, respectively, i.e., when the first guide hole, the guide hole 78 and the second guide hole 79 are located coaxially with one another.

Each of the two second switchover mechanisms 71 includes a switchover pin 82 disposed in the third rocker arm 47 at a location below the cam shaft $11_I$ and capable of connecting the third rocker arm 47 and the first rocker arm 45 to each other, a limiting member 83 abutting against the switchover pin 82, and a return spring 84 for biasing the switchover pin 82 and the limiting member 83 to disconnecting positions.

A bottomed first guide hole 85 is provided in the third rocker arm 47 in parallel to the rocker arm shaft 44 and opens toward the first rocker arm 45, and the switchover pin 82 is of a columnar shape and is slidably fitted in the guide hole 85 to define a hydraulic pressure chamber 86 between one end of the switchover pin 82 and a closed end of the guide hole 85.

A bottomed guide hole 87 is provided in the first rocker arm 45 in parallel to the rocker arm shaft 44 and opens toward the third rocker arm 47 in alignment with the guide hole 85, and the bottomed cylindrical limiting member 83 abutting against the other end of the switchover pin 82 is slidably fitted in the guide hole 87. The return spring 84 is mounted under compression between the limiting member 83 and the guide hole 87. A retaining ring 88 is fitted to an inner surface of the guide hole 87 for engagement with the limiting member 83 to inhibit the slip-off of the limiting member 83 from the guide hole 87, and an opening bore 89 is provided in a closed end of the guide hole 87.

In each such second switchover mechanism 71, the application of a hydraulic pressure to the hydraulic pressure chamber 86 causes the switchover pin 82 to be fitted into the guide hole 87 until the limiting member 83 abuts against the closed end of the guide hole 87, thereby connecting the third rocker arm 47 and the first rocker arm 45. In this connected state, the hydraulic pressure in the hydraulic pressure chamber 86 provides a biasing force directed toward the second rocker arm 46 from the first rocker arm 45 through the switchover pin 82 and the limiting member 83. If the hydraulic pressure in the hydraulic pressure chamber 86 is released, the switchover pin 82 is returned by the spring force of the return spring 84, until its face abutting against the limiting member 83 corresponds to the space between the third and first rocker arms 47 and 45, so that the connection of the third and first rocker arms 47 and 45 is released. Moreover, the connection and disconnection of the third rocker arm 47 and the first rocker arm 45 are performed in a condition in which the third rocker arm 47 is in sliding contact with the base circle-portion 43*a* of the third cam 43 and the first rocker arm 45 is in sliding contact with the base circle-portions 41*a* of the first cams 41 respectively, i.e., when the guide holes 85 and 87 are located coaxially with each other.

A first oil passage 91 and a second oil passage 92 are provided in the rocker arm shaft 44 in parallel to the axis thereof with a partition wall 93 interposed between the first and second oil passages 91 and 92. A communication passage 94 is provided in one first rocker arm 45 for permitting the first oil passage 91 to normally communicate with the hydraulic pressure chamber 77 in the first switchover mechanism 70 (see FIGS. 5 and 8) irrespective of the pivoting state of the first rocker arm 45, and communication passages 95, 95 are provided in the pair of third rocker arms 47, 47 for permitting the second passage 92 to normally communicate with the hydraulic pressure chambers 86, 86 in the second switchover mechanism 71, 71 (see FIGS. 7 and 8) irrespective of the pivoting state of the third rocker arms 47, 47.

Figure 8:
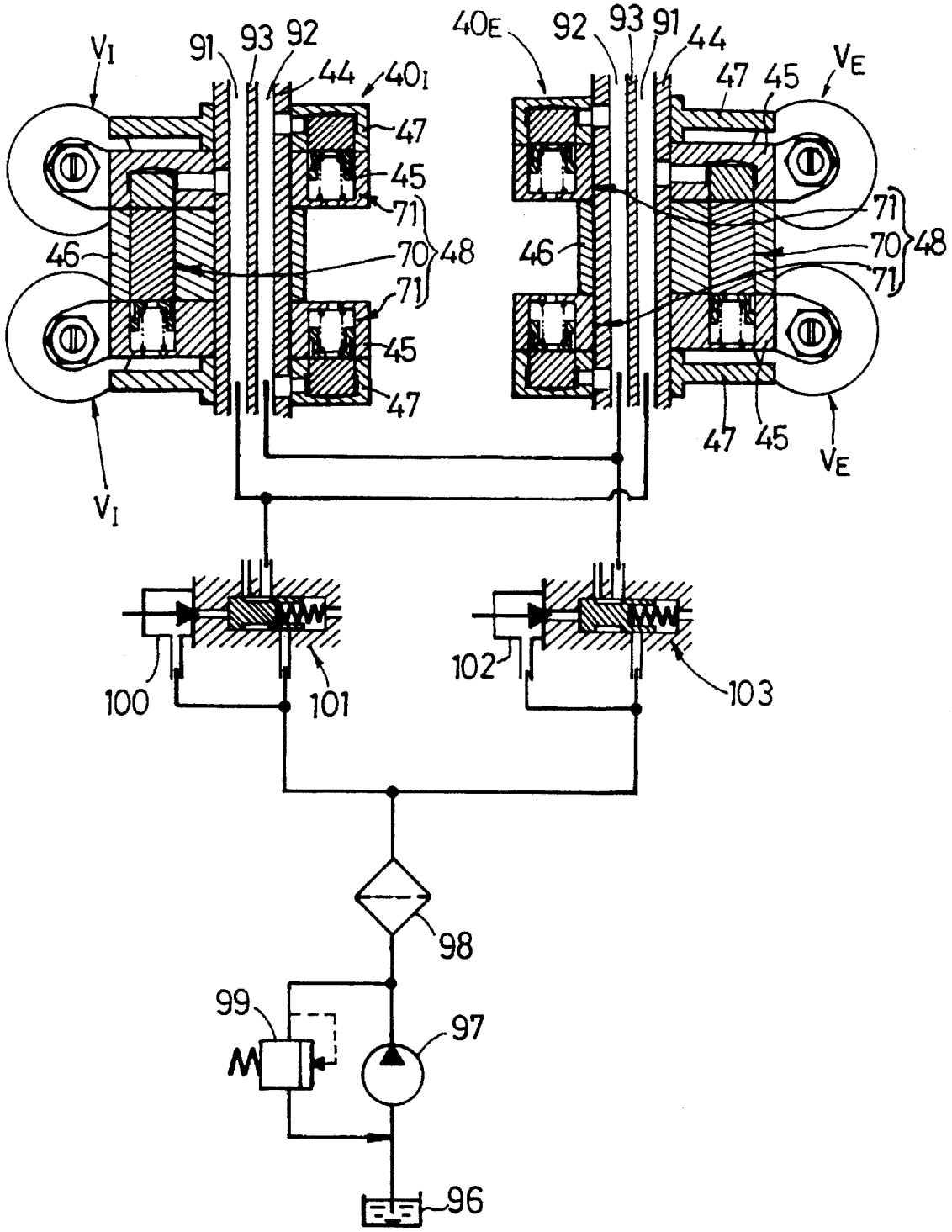
FIG. 8 is a schematic illustration of a hydraulic pressure circuit for controlling the operation of a connection switchover means.

Referring to FIG. 8, a filter 98 is connected to a discharge port of a hydraulic pump 97 for pumping a working oil from an oil reservoir 96, and a relief valve 99 is provided between the discharge port of the hydraulic pump 97 and the reservoir 96. A first hydraulic pressure control valve 101 with a solenoid valve 100 added thereto is interposed between the first oil passage 91 in the rocker arm shaft 44 and the filter 98, and a second hydraulic pressure control valve 103 with a solenoid valve 102 added thereto is interposed between the second oil passage 92 in the rocker arm shaft 44 and the filter 98. The first hydraulic pressure control valve 101 is switchable between a state in which hydraulic pressure discharged from the hydraulic pressure pump 97 is applied to the first oil passage 91, and a state in which the hydraulic pressure in the first oil passage 91 is released. The second hydraulic pressure control valve 103 is switchable between a state in which hydraulic pressure discharged from the hydraulic pressure pump 97 is applied to the second oil passage 92, and a state in which the hydraulic pressure in the second oil passage 92 is released.

Moreover, the first and second hydraulic pressure control valves 101 and 103 are controlled so that the hydraulic pressures in the first and second oil passage 91 and 92 are released at the start of operation of the engine at a low temperature. When the engine has reached a low-speed operational state after the start, the hydraulic pressure is applied to the first oil passage 91, but the hydraulic pressure in the second oil passage 92 is released. Further, when the engine has reached a high-speed operational state, the hydraulic pressure is applied to the first and second oil passages 91, 92. The connection and disconnection of the rocker arms 45, 45, 46, 47 and 47 by the operations of the first switchover mechanism 70 and the pair of second switchover mechanisms 71, 71 in response to the application and releasing of the hydraulic pressure to and from the first and second oil passages 91 and 92 will be described below with reference to FIGS. 9A, 9B and 9C.

Figure 9A:
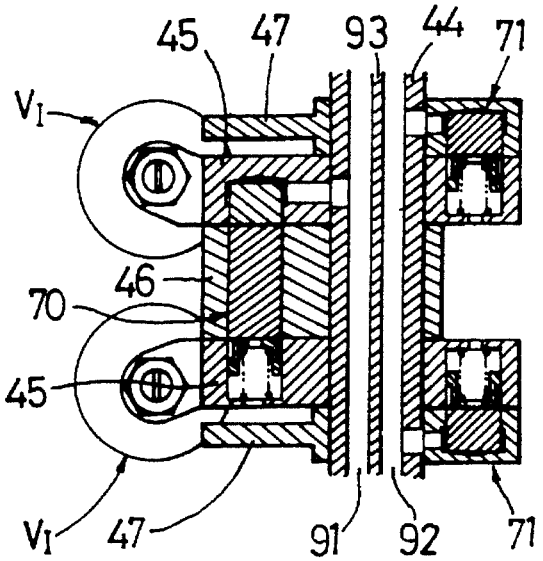
FIGS. 9A, 9B and 9C are diagrammatic sectional views illustrating operational states of an intake-side valve operating device in sequence.
Figure 9B:
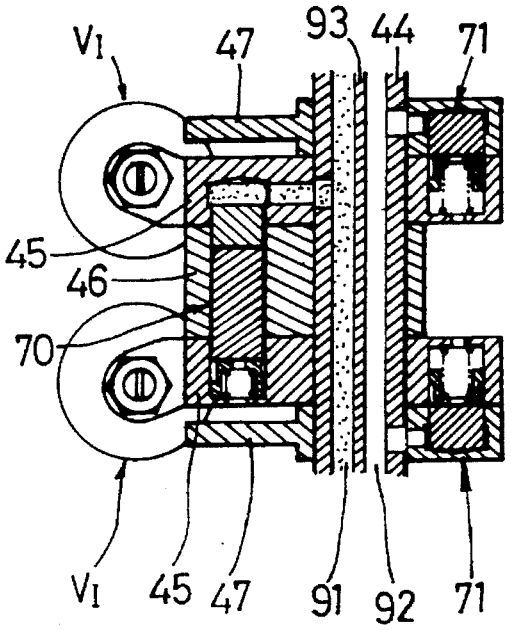
Figure 9C:
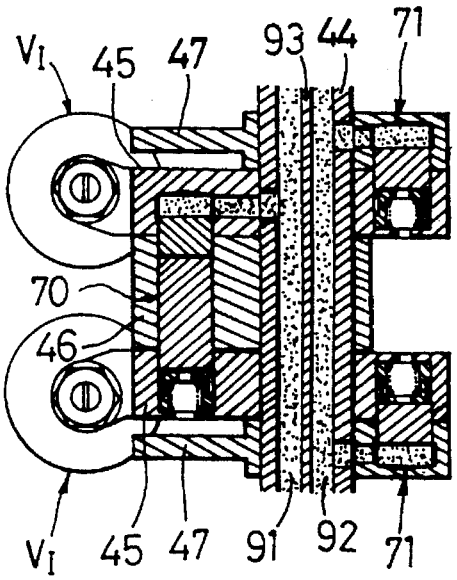

First, when the engine is in an extremely low-speed operational state such as at the start of operation at a low temperature, both the hydraulic pressures in the first and second oil passages 91 and 92 have been released and due to this, the first and second switchover mechanisms 70, 71, 71 are in their disconnected states and the rocker arms 45, 45, 46, 47, 47 are in their freely swingable states, as shown in FIG. 9A. Therefore, the pair of intake valves $V_I$, $V_I$ are opened and closed by the swinging movements of the first rocker arms 45, 45 which are in sliding contact with the first cams 41, 41, and the opening and closing characteristics of the intake valves $V_I$, $V_I$ correspond to the profile of the first cams 41, 41.

When the engine is warm and in the low-speed operational state, the hydraulic pressure in the second oil passage 92 has been released, and the hydraulic pressure is applied to the first oil passage 91, thereby operating the first switchover mechanism 70 to connect the second rocker arm 46 with the first rocker arms 45, 45 located on opposite sides of the second rocker arm 46, so that the first rocker arms 45, 45 operatively connected to the intake valves $V_I$, $V_I$ are swung along with the second rocker arm 46 by the second cam 42 and thus, the intake valves $V_I$, $V_I$ are opened and closed with operating characteristics corresponding to the profile of the second cam 42.

Further, when the engine has reached the high-speed operational state, the hydraulic pressure is applied to the first and second oil passages 91, 92, thereby maintaining the first switchover mechanism 70 at its connecting state, while operating the pair of second switchover mechanisms 71, 71 to connect the first rocker arms 45, 45 to the third rocker arms 47, 47 located on the opposite sides thereof. Namely, all the rocker arms 45, 45, 46, 47, 47 are brought into their integrally connected states, so that the first rocker arms 45, 45 are swung along with the third rocker arms 47, 47 swung by the third cams 43, 43, and the opening and closing characteristics of the intake valves $V_I$, $V_I$ correspond to the profile of the third cams 43, 43.

The exhaust-side valve operating device $\mathbf{40}_E$ basically has the same construction as the above-described intake-side valve operating device $\mathbf{40}_I$, and the detailed description thereof is omitted. However, a pair of first cams 41, 41, a single second cam 42 and a pair of third cams 43, 43 in the exhaust-side valve operating device $\mathbf{40}_E$ are provided on the cam shaft $\mathbf{11}_E$ at locations displaced through 180 degrees in the phase of rotation of the crankshaft 10 from those in the intake-side valve operating device $\mathbf{40}_I$.

Figure 10A:
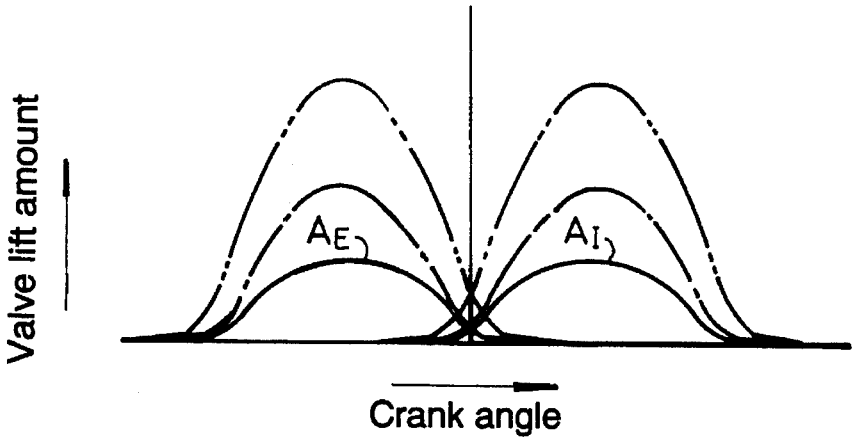
FIGS. 10A, 10B and 10C are diagrams illustrating operating characteristics of intake and exhaust valves.

The operation of this embodiment will be described below. When the engine is at an extremely low speed, e.g., at the start of operation at a low temperature, the intake valves $V_I$, $V_I$ and the exhaust valves $V_E$, $V_E$ are opened and closed by the first rocker arms 45, 45 swung by the first cams 41, 41. In other words, when the operating characteristics of the intake valves $V_I$, $V_I$ are as shown by a curve $A_I$ in FIG. 10A, the operating characteristics of the exhaust valves $V_E$, $V_E$ are as shown by a curve $A_E$ in FIG. 10A.

Moreover, the rotative speed of the crankshaft 10 is reduced by the timing transmitting device 12 to 1/4 and transmitted to the cam shafts $\mathbf{11}_I$ and $\mathbf{11}_E$, whereby the first cams 41, 41 are rotated at one rotation per four rotations of the crankshaft 10. Because the cam lobe 41*b* of each of the first cams 41, 41 protrudes from the base circle-portion 41*a* at only one circumferential point, the first rocker arms 45, 45 are swung only one time per revolution of the cam shafts, so that the intake valves $V_I$, $V_I$ and the exhaust valves $V_E$, $V_E$ are opened and closed one time per four rotations of the crank shaft 10. Thus, the internal combustion engine is brought into a 8-cycle operational state in which a suction stroke, a compression stroke (non-ignition), an expansion stroke, a compression stroke (non-ignition), an expansion stroke, a compression stroke (ignition), a burning/explosion stroke and an exhaust stroke are sequentially repeated at every rotational angle of 180 degrees (a stroke) of the crankshaft in each of the cylinders.

Here, the strokes in each cylinder in the 8-cycle operational state in the 4-cylinder internal combustion engine for four revolutions of the crankshaft 10 and one revolution of each cam shaft 11 are as shown in Table 1.

tively achieve the inhibition of discharge of harmful hydrocarbons (HC).

Figure 10B:
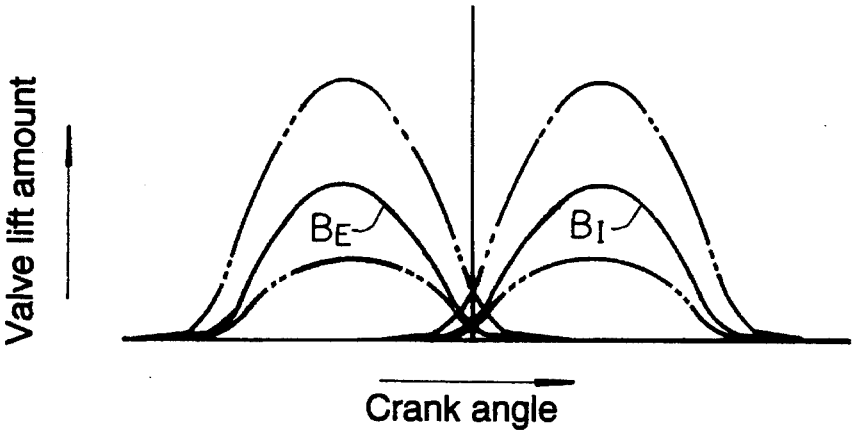

In a low-speed operational state of the warm engine after the start of operation, the intake valves $V_I$, $V_I$ and the exhaust valves $V_E$ and $V_E$ are opened and closed by the second rocker arm 46 swung by the second cam 42. Thus, when the operating characteristic of the intake valves $V_I$, $V_I$ is as shown by a curve $B_I$ in FIG. 10B, the operating characteristic of the exhaust valves $V_E$, $V_E$ is as shown by a curve $B_E$ in FIG. 10B. Moreover, the cam shafts $\mathbf{11}_I$, $\mathbf{11}_E$ are rotated at a reduction ratio of 1/4 with respect to the crank shaft 10, and since the pair of cam lobes 42*b*, 42*b* included in the second cam 42 protrude from the base circle-portions 42*a* at locations displaced 180 degrees circumferentially of the cam shafts $\mathbf{11}_I$ and $\mathbf{11}_E$, the second cam 42 performs one rotation per four rotations of the crankshaft 10 to swing the second rocker arm 46 twice, whereby the intake valves $V_I$, $V_I$ and the exhaust valves $V_E$ and $V_E$ are opened and closed one time per two rotations of the crankshaft 10. Namely, the internal combustion engine is put in a normal 4-cycle operational state and, in each of the cylinders, the suction stroke, the compression stroke (ignition), the burning/explosion stroke and the exhaust stroke are sequentially repeated in a normal manner at a rotation angle of every 180 degree of the crankshaft 10.

Figure 10C:
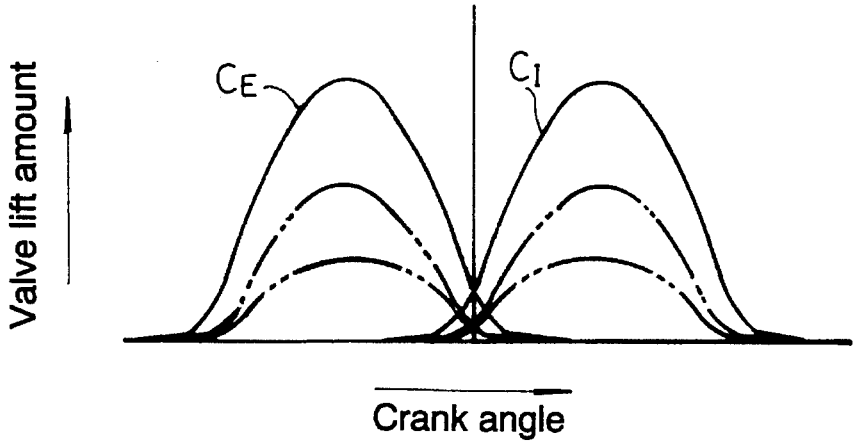

Further, in a high-speed operational state of the engine, the intake valves $V_I$, $V_I$ and the exhaust valves $V_E$ and $V_E$ are opened and closed by the third rocker arms 47, 47 swung by the third cams 43, 43. When the operating characteristic of the intake valves $V_I$, $V_I$ is as shown by a curve $C_I$ in FIG. 10C, the operating characteristic of the exhaust valves $V_E$, $V_E$ is as shown by a curve $C_E$ in FIG. 10C. Moreover, since the pair of cam lobes 43*b*, 43*b* included in the third cam 42 protrude from the base circle-portions 43*a* at locations displaced 180 degrees circumferentially of the cam shafts $\mathbf{11}_I$ and $\mathbf{11}_E$, the intake valves $V_I$, $V_I$ and the exhaust valves $V_E$ and $V_E$ are opened and closed two times per four rotations of the crankshaft 10, as in the low-speed operational state, and thus the internal combustion engine is put in the normal 4-cycle operational state. Here, the stroke of each of the cylinders in the 4-cycle operational state of the 4-cylinder internal combustion engine is as shown in Table 2.

TABLE 1

| Cam angle (degree) | 0 to 45 | 45 to 90 | 90 to 135 | 135 to 180 | 180 to 225 | 225 to 270 | 270 to 315 | 315 to 360 |
|---|---|---|---|---|---|---|---|---|
| Crank angle (degree) | 0 to 180 | 180 to 360 | 0 to 180 | 180 to 360 | 0 to 180 | 180 to 360 | 0 to 180 | 180 to 360 |
| First cylinder | Suction | Compression | Expansion | Compression | Expansion | Compression (ignition) | Explosion & burning | Exhaust |
| Second cylinder | Compression (ignition) | Explosion & burning | Exhaust | Suction | Compression | Expansion | Compression | Expansion |
| Third cylinder | Exhaust | Suction | Compression | Expansion | Compression | Expansion | Compression (ignition) | Explosion & burning |
| Fourth cylinder | Explosion & burning | Exhaust | Suction | Compression | Expansion | Compression | Expansion | Compression (ignition) |

If such 8-cycle operation is conducted, the compression stroke (non-ignition) and the expansion stroke are repeated two times between the suction stroke and the compression stroke (ignition) in each of the cylinders to promote the gasification of the fuel in the combustion chamber 24 at an extremely low speed of the engine, to stabilize the burning in the combustion chamber 24, and to improve the characteristic of increasing the temperature of the exhaust gas at the extremely low speed, thereby making it possible to shorten the time taken for the catalyst within the catalytic converter 31 to reach the activating temperature to effec-

TABLE 2

| Cam angle (degree) | 0 to 45 | 45 to 90 | 90 to 135 | 135 to 180 | 180 to 225 | 225 to 270 | 270 to 315 | 315 to 360 |
|---|---|---|---|---|---|---|---|---|
| Crank angle (degree) | 0 to 180 | 180 to 360 | 0 to 180 | 180 to 360 | 0 to 180 | 180 to 360 | 0 to 180 | 180 to 360 |

TABLE 2-continued

| | | | | | | | | |
|---|---|---|---|---|---|---|---|---|
| First cylinder | Suction | Compression (ignition) | Explosion & burning | Exhaust | Suction | Compression (ignition) | Explosion & burning | Exhaust |
| Second cylinder | Compression (ignition) | Explosion & burning | Exhaust | Suction | Compression (ignition) | Explosion & burning | Exhaust | Suction |
| Third cylinder | Exhaust | Suction | Compression (ignition) | Explosion & burning | Exhaust | Suction | Compression (ignition) | Explosion & burning |
| Fourth cylinder | Explosion & burning | Exhaust | Suction | Compression (ignition) | Explosion & burning | Compression | Expansion | Compression (ignition) |

In this way, the engine is put in the 4-cycle operational state during usual operation after the start. In the low-speed operational state, the intake valves $V_I$, $V_I$ and the exhaust valves $V_E$ and $V_E$ are opened and closed by the second cam 42 having the profile suitable for the low-speed operation, and in the high-speed operational state, the intake valves $V_I$, $V_I$ and the exhaust valves $V_E$ and $V_E$ are opened and closed by the third cams 43, 43 having the profile suitable for the high-speed operation. Thus, it is possible to provide a reduction in specific fuel consumption and an increase in power output in accordance with the operational state.

In the low-speed operational state of the engine, the intake valves $V_I$, $V_I$ and the exhaust valves $V_E$ and $V_E$ are operatively connected to the first rocker arms 45, 45 at locations spaced at substantially equal distances $d_2$, $d_2$ apart from the center position of the second rocker arm 46 along the axis of the rocker arm shaft 44. Therefore, the first rocker arms 45, 45 as well as the intake valves $V_I$, $V_I$ and the exhaust valves $V_E$ and $V_E$ operatively connected to the first rocker arms 45, 45 are disposed symmetrically with each other with respect to the plane which passes through the center of the second cam 42 along the axes of the cam shaft $\mathbf{11}_I$ and $\mathbf{11}_E$ and which is perpendicular to the axes of the cam shafts $\mathbf{11}_I$ and $\mathbf{11}_E$ and hence, the driving force from the second cam 42 is balanced and equally applied to the intake valves $V_I$, $V_I$ and the exhaust valves $V_E$ and $V_E$.

In the high-speed operational state of the engine, the third rocker arms 47, 47 swung by the third cams 43, 43 are connected to the first rocker arms 45, 45, but the positions of operative connection of the intake valves $V_I$, $V_I$ and the exhaust valves $V_E$ and $V_E$ to the first rocker arms 45, 45 are offset toward the third rocker arms 47, 47. Therefore, even in the high-speed operational state, it is possible to suppress the deflection of the driving force by the third cams 43, 43 to the intake valves $V_I$, $V_I$ and the exhaust valves $V_E$ and $V_E$ to the utmost, thereby preventing uneven wearing of the sliding contact surfaces of the cam slipper 63, 63 provided on the third rocker arms 47, 47 and the third cams 43, 43.

Moreover, in the high-speed operational state, the first switchover mechanism 70 is also in the connecting state and the pair of second switchover mechanisms 71, 71 are in the connecting states, thereby integrally connecting all the rocker arms 45, 45, 46, 47 and 47. Therefore, when the operational state is changed from the medium-speed operational state to the high-speed operational state, the hydraulic pressure may be applied to the hydraulic pressure chambers 86 in the second switchover mechanisms 71, 71 without releasing the hydraulic pressure in the chamber 77 of the first switchover mechanism 70. When the operational state is changed from the high-speed operational state to the low- or medium-speed operational state, the hydraulic pressure in the hydraulic pressure chambers 86 may be released and hence, the switchover operation in the changing between the low- or medium-speed operational state and the high-speed operational state can be promptly achieved in either direction. The lost motion mechanisms 64, 64 for resiliently biasing the third rocker arms 47, 47 in the direction of sliding contact with the third cams 43, 43 come into resilient sliding contact with the pressure receiving portions 47*a*, 47*a* projectingly provided on the third rocker arms 47, 47 in the vicinity of the axis of the rocker arm shaft 44, whereby an increase in inertial weight of the third rocker arms 47, 47 can be suppressed.

Moreover, the first switchover mechanism 70 is disposed at a location below the cam shafts $\mathbf{11}_I$ and $\mathbf{11}_E$ in the second rocker arm 46 as well as the first rocker arms 45, 45 on the opposite sides of the second rocker arm 46, and the second switchover mechanisms 71, 71 are also disposed at locations below the cam shafts $\mathbf{11}_I$ and $\mathbf{11}_E$ in the first rocker arms 45 and the third rocker arms 47. Therefore, when these switchover mechanisms 70, 71, 71 are in the connecting states, the driving forces from the cams 41, 41, 42, 43 and 43 can be received by the switchover pins 72, 73, 82 and 82 which are components of the switchover mechanisms 70, 71, 71, thereby enhancing the rigidity of the connected rocker arms.

Although the embodiment of the present invention has been described in detail, it will be understood that the present invention is not limited to the above-described embodiment, and various modifications in design may be made without departing from the spirit and scope of the invention defined in claims. For example, in the high-speed operational state of the engine, only the pair of second switchover mechanisms 71, 71 in the connection switchover means 48 may be operated for connection. Also, the pair of first cams 41, 41 may be formed into different profiles, so that a swirl may be effectively produced within the combustion chamber 24 at the low-temperature start of the engine. Further, each of the first, second and third rocker arms may be single for operating only a single intake valve $V_I$ and a single exhaust valve $V_E$. The present invention also may be applied to an SOHC type internal combustion engine.

What is claimed is:

1. A valve-operation control system for an internal combustion engine, comprising a timing transmitting device for transmitting the rotational power of a crankshaft at a speed reduction ratio of 1/4 to a cam shaft;

intake-side and exhaust-side valve operating devices each including a first cam provided on said cam shaft and having a single cam lobe protruding outwardly with a valve-opening profile suitable for an extremely low-speed operation of the engine, a second cam provided on said cam shaft and having a pair of cam lobes provided at locations circumferentially spaced apart by 180 degrees to protrude outwardly with a valve-opening profile suitable for a low-speed operational state of the engine, a third cam provided on said cam shaft and having a pair of cam lobes provided at locations circumferentially spaced apart by 180 degrees to protrude outwardly with a valve-opening profile suitable for a high-speed operational state of the engine;

first, second and third rocker arms following the first, second and third cams; respectively, and a connection switchover means provided in said first, second and third rocker arms for switching a selective connection and disconnection of said first rocker arm to and from said second and third rocker arms depending upon operational states of the engine, said first rocker arm being operatively connected to at least one of an intake valve and an exhaust valve.

2. The valve-operation control system of claim 1 wherein a pair of valves are provided as at least one of said intake valve and exhaust valve, and wherein for said pair of valves, a pair of said first cams and a pair of said third cams are provided and a corresponding pair of said first rocker arms and a corresponding pair of said third rocker arms are provided.

3. The valve-operation control system of claim 2 wherein said second cam and second rocker arm are positioned between said pair of first cams and first rocker arms.

4. The valve-operation control system of claim 2 or 3 wherein said pair of first cams and said pair of first rocker arms are positioned between said pair of third cams and said pair of third rocker arms, respectively.

5. The valve-operation control system of claim 1, 2 or 3 wherein said connection switchover means includes means for interconnecting all of said first, second and third rocker arms in a high-speed operational state of the engine.

6. The valve-operation control system of claim 2 or 3 wherein said connection switchover means includes a first means for connecting and disconnecting one adjacent set of one of said first rocker arms and one of said third rocker arms and a separate second means for connecting a remaining adjacent set of one of said first rocker arms and one of said third rocker arms.

* * * * *